United States Patent [19]

Olson

[11] 4,350,307

[45] Sep. 21, 1982

[54] TWO-SIDED MAGNETIZED DIVERTING PLATE FOR HAMMERMILL

[76] Inventor: Gerald R. Olson, Rte. 2, Box 256, Shakopee, Minn. 55379

[21] Appl. No.: 117,460

[22] Filed: Feb. 1, 1980

[51] Int. Cl.[3] ..... B02C 13/286

[52] U.S. Cl. ..... 241/81; 241/186.3; 241/189 A

[58] Field of Search ..... 241/81, 186 R, 186.2, 241/186.3, 189 R, 189 A

[56] References Cited

U.S. PATENT DOCUMENTS

| | | | |
|---|---|---|---|
| 2,276,940 | 3/1942 | Dellinger et al. . | |
| 2,293,664 | 4/1942 | Roberts . | |
| 2,491,661 | 12/1949 | Gruendler | 241/186.3 X |
| 2,514,111 | 7/1950 | Wilson | 241/189 A X |
| 3,510,072 | 5/1970 | Jacobson et al. | 241/186 R |
| 3,915,397 | 10/1975 | Olson | 241/189 A |

FOREIGN PATENT DOCUMENTS

| | | | |
|---|---|---|---|
| 963011 | 6/1950 | France | 241/81 |
| 174148 | of 1935 | Switzerland . | |

*Primary Examiner*—Howard N. Goldberg
*Attorney, Agent, or Firm*—Leo Gregory

[57] ABSTRACT

A feed diverting guide plate at the material entrance to the grinding chamber of a hammermill, the plate being magnetized on both sides thereof and being tiltably reversible in position, the magnetized sides of the guide plate attracting with one side thereof tramp iron from the material entering the grinding chamber and attracting with the other side thereof tramp iron from the material being circulated through the grinding chamber.

7 Claims, 6 Drawing Figures

TWO-SIDED MAGNETIZED DIVERTING PLATE FOR HAMMERMILL

BACKGROUND OF THE INVENTION

1. Field of Invention

This invention relates to magnetized diverting plates at the material entrance to the grinding chamber of a hammermill.

2. Description of the Prior Art

The use of magnetic means to separate tramp iron from material received into a hammermill is known in the art. Representative of such means is the disclosure in the German Patent No. 174,148 issued to Fritz Kung in which a magnetic separator underlies the wall of the entrance into the grinding chamber but the only tramp iron attracted is that from material entering the entry chute and there is no further removal of tramp iron from the material in the grinding chamber. The U.S. Pat. No. 2,293,664 dated Aug. 18, 1942 to A. Roberts discloses a magnetic separator on the underside of the entrance chute over which incoming material passes and there is no further extraction of said tramp iron from the incoming material once it passes into the grinding chamber.

The U.S. Pat. Nos. 2,491,661 dated Dec. 20, 1949 to W. P. Grundler and 2,514,111 dated July 4, 1950 to J. G. Wilson disclosed tilting diverting plate members located adjacent the inlet chutes to grinding chamber but there is no teaching present which indicates how to combine what is shown to indicate the structure as disclosed and claimed hereinafter by the applicant whereby tramp iron is withdrawn from material both upon passing into a grinding chamber and upon being circulated therein.

SUMMARY OF THE INVENTION

The invention herein discloses a significant improvement in the art of removing tramp iron from material fed into the grinding chamber of a hammermill by attracting tramp iron from incoming material and also by subsequently attracting tramp iron from material being circulated within the grinding chamber.

It is an object of the invention herein to provide a diverting guide plate at the entry chute of a hammermill in which the diverting plate has magnetic qualities on each side surface thereof with said plate being positioned to have incoming material pass over one side thereof and the material being circulated through the grinding chamber coming into engagement with the other side thereof.

More specifically stated, the invention herein relates to a hammermill in which a material guiding plate positioned adjacent to the entry chute thereof is magnetized on each side thereof and said plate member in whatever diverting position it may be placed, incoming material passes over one side thereof to have tramp iron attracted from incoming material and the material circulating through the grinding chamber under the action of the hammers within said chamber is thrown against the other side of the said guiding plate facing into said grinding chamber which attracts tramp iron from said material being circulated in said grinding chamber.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
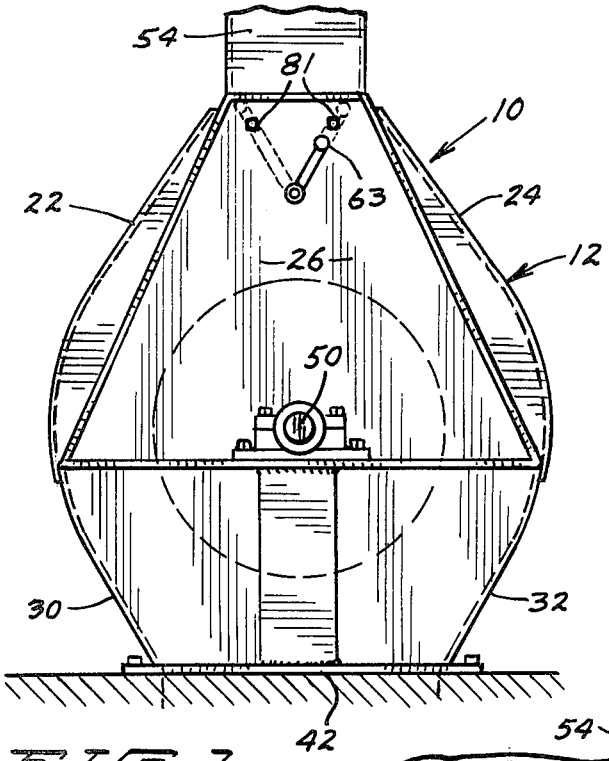
FIG. 1 is a view in end elevation with some parts thereof being indicated in dotted line.

Referring to the drawings, a hammermill is indicated generally by the reference numeral 10.

Figure 2:
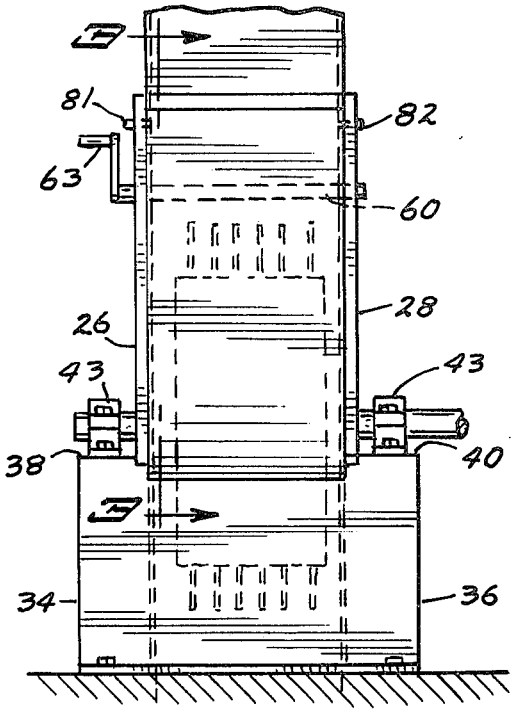
FIG. 2 is a view in side elevation with parts thereof being indicated in dotted line and a portion thereof being broken away.

Said hammermill comprises a housing 12 having upper upwardly inwardly inclined side walls 22 and 24 and upper front and rear walls 26 and 28, and lower side walls 30 and 32 which as here shown are downwardly and inwardly inclined and lower front and rear walls 34 and 36. Said upper and lower walls are integral in construction with said lower front and rear walls having projections 38 and 40 forming ledges as indicated in FIG. 2. Said housing 12 is seated upon a suitable base plate 42.

Formed within said housing 12 is a grinding chamber 45 having an upper tapered chamber portion **45*a***.

The upper portion of said housing by its tapered configuration is contiguous with an upwardly extending material inlet or entry chute 47 indicated here to be substantially rectangular in horizontal section and having a passage 54 therein communicating with the grinding chamber 45. About said grinding chamber is a screen 23.

Extending transversely through the lower portions of the walls 22 and 24 and being journaled in bearing blocks 43 supported upon said ledges 38 and 40 is a shaft 50 having mounted thereon in a known manner a conventional hammermill assembly 52. Said shaft will be connected to a power source not here shown.

Positioned centrally below the base portion **54*a* of said passage 54 in close proximity to the periphery of the path of travel P of the hammers 52*a* of the hammer assembly 52 is a shaft 60 journaled in a suitable manner in the side walls 22 and 24 with one end portion thereof extending outwardly of said wall 26 to have a crank 63** attached thereto.

Mounted upon said shaft 60 is a diverting plate member 70 which is magnetized at both of its sides 71 and 72.

The plate member 70 may be variously formed and the present plate member is indicated as being formed of a pair of magnetized ceramic elements suitably insulated from one another and forming opposed sides of said plate member and said elements are encased in a stainless steel cover 73. The detail of construction with regard to the particular form of and the enclosure of the magnetic elements indicated is not here shown as this construction is known in the art.

Integral with the side edge portions **70*a* and 70*b* of said plate member the length thereof are tubular members 74 and 75** and said members may be secured as by welding.

Said shaft 60 is disposed, as here shown, through the tubular member 74 and will be secured thereto to be rigid therewith as by the use of set screws not here shown.

The plate member 70 is of such a length as to extend across the width of said entry chute 47 and across the width of the grinding chamber 45. The lower or tubular portion 74 of said diverting plate member, as viewed in FIGS. 3 and 4, shall be in such close proximity to the path P of the hammers 52*a* that material M being circulated throughout the grinding chamber by the action of the hammers will not pass beyond the diverting plate member without being thrust against the facing surface 72 thereof as viewed in FIG. 4.

Figure 3:
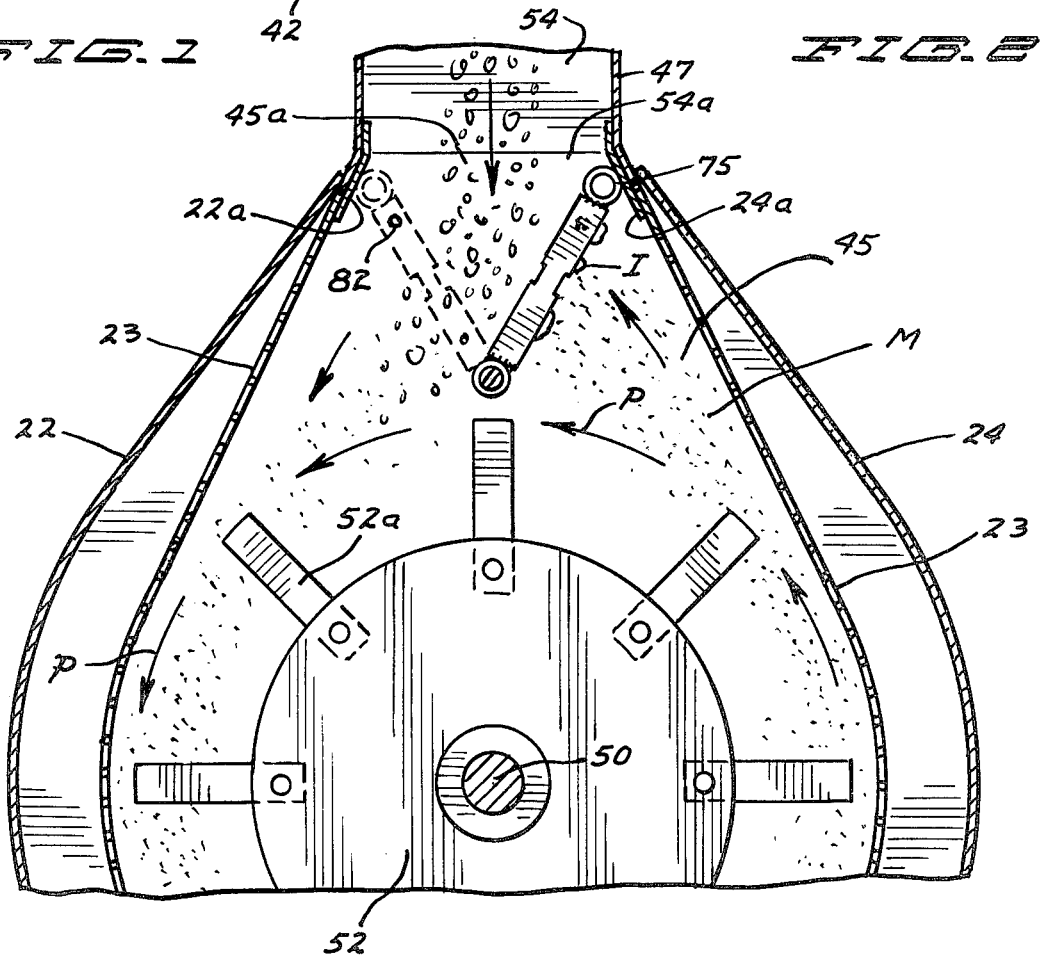
FIG. 3 is a view on an enlarged scale in vertical section taken on line 3—3 of FIG. 2 as indicated.

With the diverting plate member being mounted upon the shaft 60, said plate member will have a width such as to extend to have its tubular portion 75, as indicated in FIG. 3, rest against the upper end portion 24*a* of the side wall 24 or reversely of the upper end portion 22*a* as indicated in dotted line in FIG. 3, said points of engagement being at the juncture of said grinding chamber 45 with the entry chute 47.

Thus said plate member 70 is so positioned that material circulating within the grinding chamber cannot pass the facing side of said diverting plate without being thrust there against for the attraction and extraction of tramp iron I.

By operation of the crank 63, said plate member 70 may be positioned to direct material into the grinding chamber in a counter clockwise direction as viewed in FIG. 3 with said plate member being in solid line or said plate member may be reversely positioned to direct material into said grinding chamber in a clockwise direction as indicated by said plate member positioned in dotted line in FIG. 3.

Said diverting plate member is held in operating position in the embodiment here shown by the use of set screws 81 and 82 as indicated in FIG. 2. Said set screws are shown carried in the front and rear walls 26 and 28 as indicated and are mounted to be threaded inwardly to engage the adjacent side edge portions of said plate member as indicated in FIG. 2. Two pairs of said set screws are provided for engagement of said plate member in each of its two operating positions as shown. Only one of said second pair of set screws is shown in FIG. 1.

Figure 4:
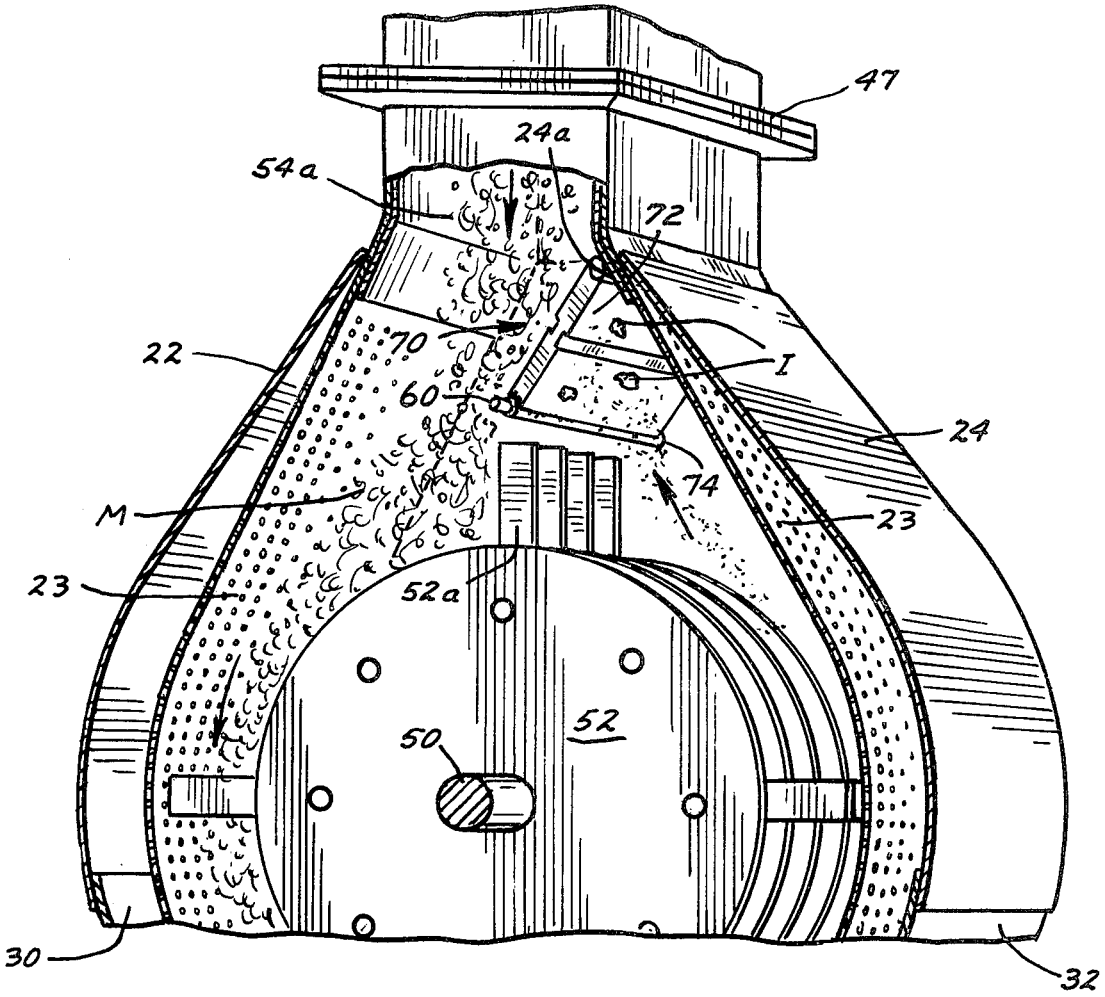
FIG. 4 is a broken view in perspective on an enlarged scale showing the device herein in operating position.
Figure 5:
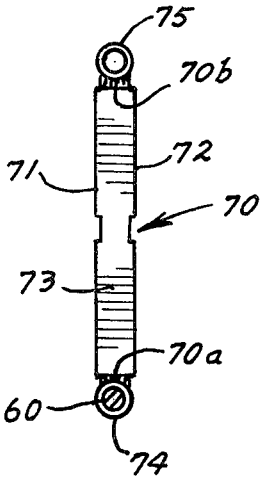
FIGS. 5 and 6 are respectively a view in end elevation of the diverting plate comprising the invention herein and a top plan view.
Figure 6:
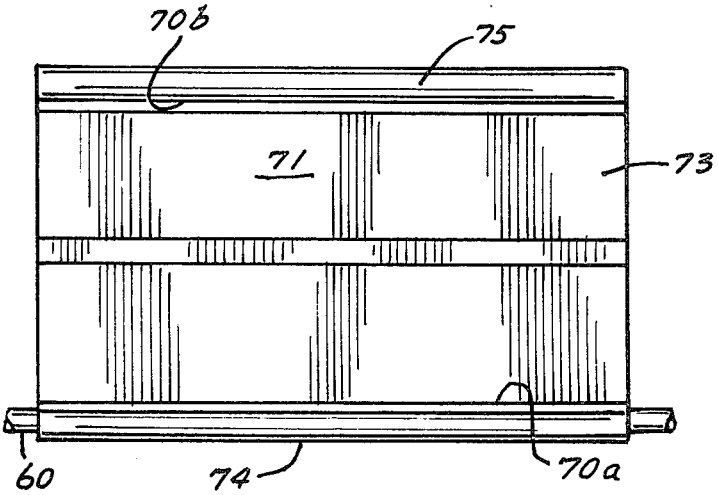

In operation, with reference to FIG. 4, it is seen that all receiving material passes over the upper facing side of the plate member 50. With the volume of material passing into the grinding chamber only a portion of the iron present in the material is attracted and held.

The second step in this operation is a very significant step and represents substantial improvement in the art. The diverting plate member 70 must of necessity, within the inventive concept herein, be positioned with regard to the grinding chamber that the entire circulation of material within the grinding chamber comes into contact with the underlying magnetized side of said plate member for the further and continuing attraction of tramp iron I and its extraction or removal from said material throughout its grinding process.

Said diverting plate member has been very successfully tested under operating conditions and insures a higher degree of freedom from possible internal combustion resulting from iron sparks than has heretofore been present.

It will of course be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. A hammermill having therein an entry chute for incoming material leading into a grinding chamber and a hammer assembly mounted within said grinding chamber, in which the improvement consists of a hammermill housing, a grinding chamber within said housing, an entry chute leading into said housing, a plate member disposed between said entry chute and said grinding chamber, means carried by said housing supporting said plate member, said plate member having a length to traverse the width of said entry chute and of said grinding chamber, the upper surface portion of said plate member extending across the path of incoming material through said entry chute, the underlying surface portion of said plate member extending across the path of material circulating within said grinding chamber, said upper and underlying surface portions of said plate member being magnetized whereby said plate member attracts and extracts tramp iron from incoming material passing into said housing through said entry chute and from material circulating within said grinding chamber.

2. The structure set forth in claim 1, wherein said means comprises a shaft disposed transversely of said hammer assembly and journaled in said housing supporting said plate member adjacent the periphery of the path of said hammer assembly.

3. The structure set forth in claim 2, including means in connection with said shaft securing said plate member in an operating position to direct material from said entry chute passing thereover to enter said grinding chamber in a clockwise direction or in a counter clockwise direction in the alternative.

4. The structure set forth in claim 3, wherein said means in connection with said shaft comprises a crank carried externally of said housing.

5. The structure set forth in claim 2, wherein said plate member has a height extending from adjacent the periphery of the path of said hammer assembly to the point of juncture of said entry chute and the adjacent wall of said grinding chamber.

6. The structure of claim 2, including means carried by said housing securing said plate member in operating position.

7. The structure set forth in claim 6, wherein said means comprises set screws.

* * * * *